US005771635A

United States Patent [19]

Skinner

[11] Patent Number: 5,771,635

[45] Date of Patent: Jun. 30, 1998

[54] PNEUMATIC DEVICE AND SYSTEM

[75] Inventor: Keith Thomas Skinner, Coventry, England

[73] Assignee: Xcalibre Equipment, Ltd., England

[21] Appl. No.: 646,364

[22] PCT Filed: Sep. 18, 1995

[86] PCT No.: PCT/GB95/02208

§ 371 Date: Aug. 16, 1996

§ 102(e) Date: Aug. 16, 1996

[87] PCT Pub. No.: WO96/08657

PCT Pub. Date: Mar. 21, 1996

[30] Foreign Application Priority Data

Sep. 16, 1994 [GB] United Kingdom ..... 9418662

[51] Int. Cl.[6] ..... E05F 15/20

[52] U.S. Cl. ..... 49/25; 49/340; 92/136

[58] Field of Search ..... 49/25, 339, 340, 49/341, 345; 92/136, 82, 130 R

[56] References Cited

U.S. PATENT DOCUMENTS

| | | | |
|---|---|---|---|
| 4,222,147 | 9/1980 | Burnett, Jr. . | |
| 4,455,708 | 6/1984 | Saigne | 92/136 X |
| 4,580,365 | 4/1986 | Sieg | 49/336 |
| 4,763,937 | 8/1988 | Sittnick, Jr. et al. | 49/25 X |
| 4,972,629 | 11/1990 | Merendino et al. | 49/25 |
| 4,979,261 | 12/1990 | Lasier et al. | 49/340 X |
| 5,353,690 | 10/1994 | Shin | 92/136 X |
| 5,386,885 | 2/1995 | Bunzi et al. | 49/340 X |
| 5,513,467 | 5/1996 | Current et al. | 49/340 |

*Primary Examiner*—Peter R. Brown
*Assistant Examiner*—Rodney B. White
*Attorney, Agent, or Firm*—Barnes & Thornburg

[57] ABSTRACT

A pneumatic device 10 comprises a piston 12 moveable along a cylinder 10. The piston has opposite ends 18, 26 defining a space 30 therebetween. The space is divided into two chambers 30*a*, 30*b* by a housing 40 fixed relative to the cylinder and having a fluid flow control passageway 42 therethrough. The space 30 is filled with fluid, such as oil. The piston 12 is arranged such that movement thereof against a spring 16 causes the fluid to be displaced from one chamber 30*a* of the space 30 to the other chamber 30*b* through the passageway 42. The spring 16 is arranged to apply a return force to the piston 12 and the rate of return of the piston 12 is controlled by the return flow of fluid through the passageway 42. A pneumatic system 100 includes a device 10 connected between first and second members 58, 58*a* of a building, such as a door and door frame. The pneumatic system comprises a source of compressed gas C for operating the device 10 to enable the device 10 to move the first member 58 relative to the second member 58*a*, ie to open and close the door. A switching device 72 controls the supply of compressed gas to the device 10.

26 Claims, 4 Drawing Sheets

PNEUMATIC DEVICE AND SYSTEM

The invention relates to a pneumatic device and system and is particularly, but not exclusively concerned with the system for use in environments where elderly or disabled persons are unable to perform simple operations such as opening doors or windows.

In institutions such as homes for the elderly or infirm, it is invariably a requirement that doors giving access to rooms are to be kept closed in order to comply with fire regulations. In order to ensure that doors are closed, commonplace door closers are used between the door and the door frame. Typically, a door closer is a hydraulic device mounted on the door and which is connected to a door frame through a pair of pivotally connected arms.

Door closers can present a problem to persons with mobility problems who find it impossible to open the door and must call for assistance when entering and leaving their room. Obviously, such an arrangement limits the freedom of the individual.

In order to overcome the foregoing problem, it has been proposed to use electrically operated door closers which can be operated remotely by the person concerned to enable that person to open the door without calling for assistance. However, electric door closers require the use of a powerful electric motor and complex control circuitry. The cost of such closers and the maintenance thereof has therefore proved to be very expensive.

An object of the present invention is to provide a pneumatic system which will help to overcome the foregoing problems.

According to one aspect of the invention there is provided a pneumatic device comprising a body having a bore, a piston movable in the bore against a resilient bias, the piston having opposite ends defining a chamber therebetween, the chamber being divided by a wall fixed relative to the body and having a fluid flow control aperture therethrough, the chamber being filled with fluid, movement of the piston against the resilient bias causing the fluid to be displaced from one side of the wall to the other side through the aperture, the resilient bias being arranged to apply a return force to the piston, whereby the rate of return of the piston is controlled by the return flow of fluid through the aperture.

The piston may be formed with a drive surface for operating a drive member. Preferably, the drive member is rotatable. In such a case, the drive surface may be a toothed rack and the drive member may be a pinion. The ends of the piston are preferably connected by the rack. The rack preferably extends through an opening in the wall and the aperture is defined by the clearance between the rack and the opening. The wall preferably supports the drive member.

The fluid in the chamber may be a hydraulic fluid, preferably oil.

The wall may have a through bore, a non-return valve being disposed therein and arranged so that only fluid displaced from said one side into said other side is allowed to pass through the bore. Thus fluid displaced in the opposite direction is forced to travel through the aperture.

The wall may have a regulator through bore and a flow control valve in said bore the valve having a member movable to alter the cross sectional area of the regular through bore so that the flow rate of fluid from said other side to said one side can be regulated. In that way the rate of return of the piston is controlled further.

According to a second aspect of the invention, there is provided a pneumatic device connected between two members one of which is movable relative to the other, the device comprising a piston reciprocal in a bore against a resilient bias, the rate of movement of the piston being controlled by gas flow control means.

In a preferred embodiment of the second aspect, the resilient bias is arranged so that gas is drawn into the bore when the piston moves against the resilient bias and the gas flow control means controls that rate at which the drawn in gas is expelled from the bore.

Preferably the rate at which the piston travels against the resilient bias is undamped by the gas flow control means.

The gas flow control means preferably comprises a switchable valve adapted to select an inlet path for movement of the piston against the resilient bias and an outlet path for movement of the piston in the opposite direction. The valve is preferably normally switched to select the outlet path. The outlet path preferably includes a restrictor. The inlet path may lead from a source of compressed gas. A further path may be provided in parallel with the outlet path leading from atmosphere to the bore via a non-return valve. Such an arrangement allows a door on which the device is fitted to be opened manually while the valve is switched to the outlet path. In a preferred embodiment the bore communicates with the valve via a common passage.

The valve may be power operated or manually operated. Preferably the bore is open at one end.

According to a third aspect of the invention there is provided a pneumatic system including a device in accordance with either of the first and second aspects of the invention and any of the consistory clauses related thereto.

Preferably, the pneumatic system includes a source of compressed gas for operating the device to enable the device to move a first member relative to a second member and a switching device which causes the compressed gas to be supplied to the device.

Preferably the device is connected between first and second members of a building such as premises for the disabled or infirm.

Such a system can be used to control, for example, a window or a door. In such a case, an elderly or infirm person can operate the switch to open the door or window for themselves thereby giving them greater freedom by not having to rely on assistance.

Where the first member is a door, the second member may be an adjacent surface such as a frame of the door. The device is preferably arranged to open the door when the compressed gas is supplied thereto and subsequently to provide a closing movement for the door which is preferably damped for at least part of its return movement.

Although such a device has been disclosed in relation to the opening and closing of the door, it may be used in other situations where a damped return movement is required. For example, the device may be used in a chair-lift, used for example for raising a chair and subsequent lowering into a bath. The damped movement may be used when lowering the chair in order to reduce the rate of downward travel.

For ease of installation, small bore piping e.g. 1.5 mm bore may be used to duct gas between the source and the control valve. Such piping can be easily installed by clipping to the tops of skirting boards in the building. Such small bore piping can be installed more easily than telephone cable as electrical connections are unnecessary; connections to components of the system simply being made by push-fit over barbed connectors.

The source of compressed gas may power a plurality of devices eg door closers for a plurality of doors of the building. Moreover, the system may include a sensor arranged near the door to sense the proximity of a person approaching the door and to operate the switching device to open the door. One or more passive infra-red (PIR)sensors may be arranged, for example, at strategic points along corridors where two or more doors are provided.

The device may include a sensor which activates the device to open the door when manual force is applied to the door. Preferably the sensor senses a change in pneumatic pressure in the device.

As mentioned above, the pneumatic system may be arranged to permit a person to open and close a window to avoid having to call for assistance.

Beds and wheelchairs can be provided with inflatable cushion like devices, areas of which can inflate and deflate relative to each other in order to vary pressure points on a person's body thereby reducing the likelihood of body sores. At present, wheelchairs and beds require individual sources of compressed gas to operate the cushions, which arrangement is cumbersome and expensive. With a system in accordance with the present invention, tappings can be located at convenient points to provide sources of compressed gas for such cushions.

Embodiments of the invention will now be described in detail by way of example and with reference to the accompanying drawings in which:

Fig. 2 is s cross-section of the device of FIG. 1 taken on line II—II in FIG. 1 shown attached to a door or the like;

Figure 1:
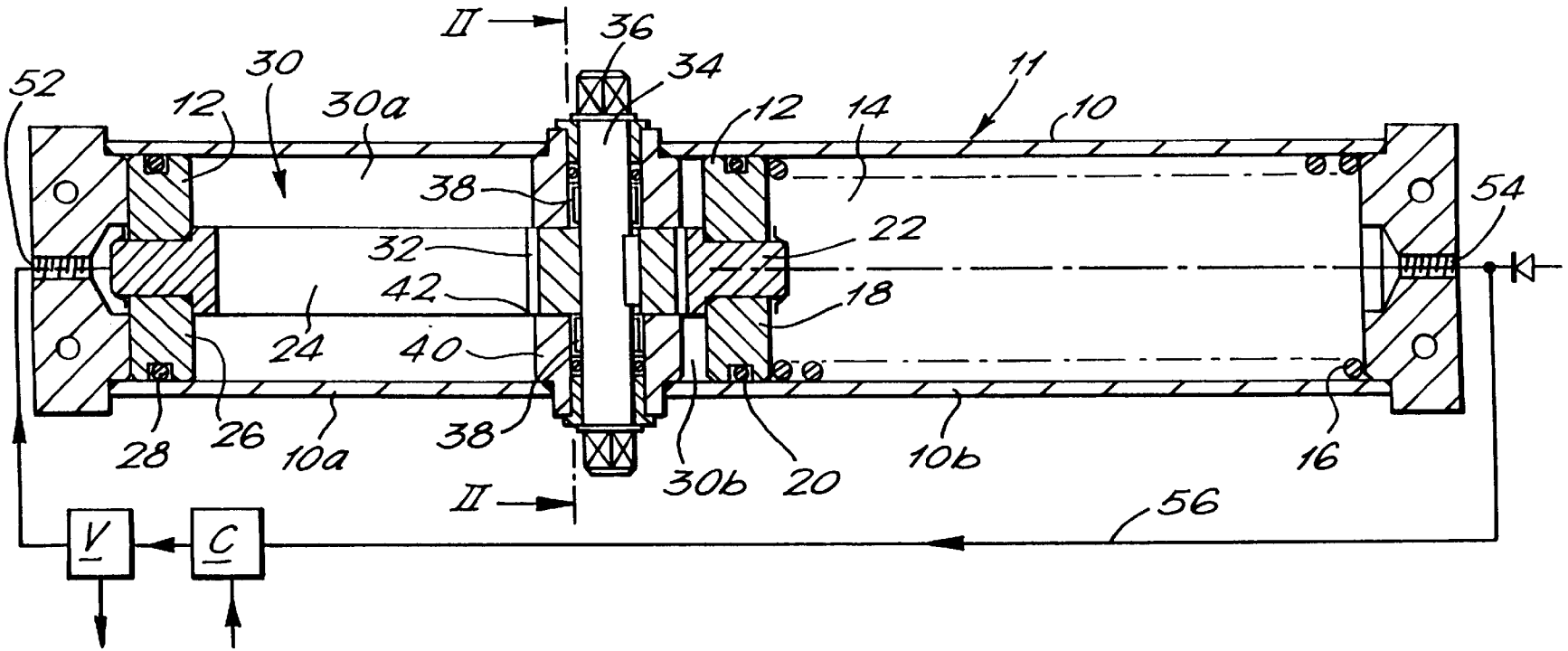
FIG. 1 is a longitudinal cross-section through a pneumatic device in accordance with the invention.
Figure 2:
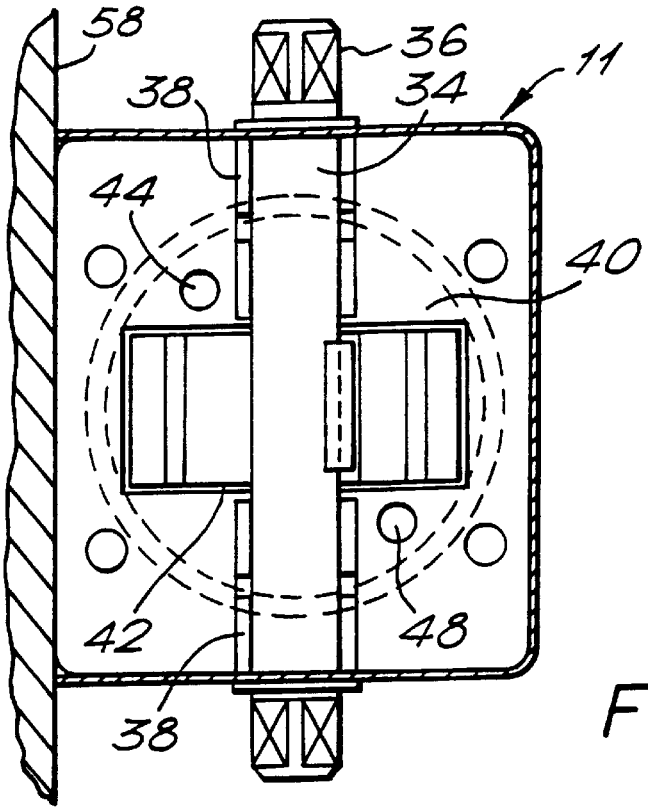

FIGS. 1 and 2 show a pneumatic device 11 in accordance with the invention. In FIG. 1 a cylinder 10 of the pneumatic device 11 contains a piston 12 reciprocal therewithin. The cylinder 10 comprises two parts lO*a*, l0*b* which are coaxial. The piston 12 is urged to one end of the cylinder by a return spring 16 located in the space 14.

The piston 12 comprises first and second piston heads 18, 26 which are connected by elongate member 22. The first piston head 18 abuts one end of the spring 16 and has a peripheral gas-tight seal 20. The elongate member 22 has a rack 24 formed thereon. The second piston head 26, also has a peripheral gas-tight seal 28. A space 30 is defined between the piston heads 18, 26 within the cylinder and contains a hydraulic fluid, such as oil.

The rack 24 meshes with a gear 32 which turns a drive shaft 34. The shaft 34 terminates in square drive sections 36. The shaft 34 is carried by bearings 38 mounted in a shaft housing 40. The housing 40 is circular and has opposite shoulders to locate the two parts 10*a*, 10*b* of the cylinder 10, which are fastened, e.g. by bolts, around the housing 40 to seal the inner wall of the cylinder around its periphery. The shaft 34 projects from both sides of the cylinder 10 through openings (not shown). The space 30 is divided into chambers 30*a*, 30*b* by the shaft housing 40. A small clearance between the elongate member 22 and an opening in the shaft housing 40 defines a passageway 42, as shown in Fig.2. The housing 40 has a through bore 44 (see FIG. 2). The bore 44 has a non-return valve 46 (not shown) therein allowing one-way flow of oil through the bore from left to right in FIG. 1. A regulator bore 48 is formed through the housing 40. The regulator bore 48 has a flow control valve 50 (not shown), such as a needle valve disposed therein allowing flow of oil in either direction.

The cylinder 10 has an air inlet 52 at its end adjacent the piston head 26 which allows compressed air from a compressor C to be pumped into the cylinder 10 via a valve V.

An air outlet 54 is located in the opposite end of the cylinder 10 adjacent the spring 16. If desired, an air line 56 can carry the air from the outlet 54 back to the compressor C which also draws air from the atmosphere.

In use, the cylinder 10 is attached, for example, to a door 58 (see FIG. 4) by suitable fixings (not shown). One of the drive sections 36 is drivably connected to one end of an arm A1 and the other end of the arm A1 is pivotally connected to one end of a second arm A2. The other end of the arm A2 is pivotally connected to a frame 58*a*. The cylinder 10 and arms A1, A2 layout on the door/frame is conventional.

In use, air is supplied from the compressor to the air inlet 52. The piston 12 is forced to the right, as viewed in FIG. 1, against the action of the spring 16.

As the piston 12 moves, the rack 24 on the elongate member 22 moves over the gear 32 which causes it to turn the drive shaft 34. The drive shaft 34 turns the drive sections 36 which open the door 58.

Movement of the piston 12 also alters the volume of the chambers 30*a*, 30*b* of the space 30 between the piston heads 18, 26 causing oil to be displaced from one chamber 30*a* to the other chamber 30*b* through the bore 44. The piston 12 also forces air out from the space 14 through the air outlet 54.

Air pressure is maintained in the left hand side of the cylinder for a predetermined period to hold the door open. After the predetermined period has expired the valve V is vented to atmosphere and air escapes from the left hand side of the piston. The piston 12 is pushed to the left of the cylinder under the action of the spring 16. Air is drawn into the space 14 via outlet 54. The oil in the chamber 30*b* is forced back into the chamber 30*a* and as the bore 44 is blocked by the non return valve 46, the oil must flow through the fluid flow control passageway 42. The restricted nature of the passageway 42 causes the oil to flow through at a low flow rate which controls the rate at which the piston 12 returns to the left hand side of the cylinder and thus the rate at which the door 58 is closed.

The flow control valve 50 may be adjusted within the regulator bore 48 to vary the rate at which fluid flows therethrough, thereby varying the rate at which the door 58 can be closed.

A Passive Infrared Sensor (PIR) can be located, eg above the door 58, to sense the presence of someone approaching the door. A signal can then be sent in response to operate the valve V, thereby opening the door 58.

Figure 4:
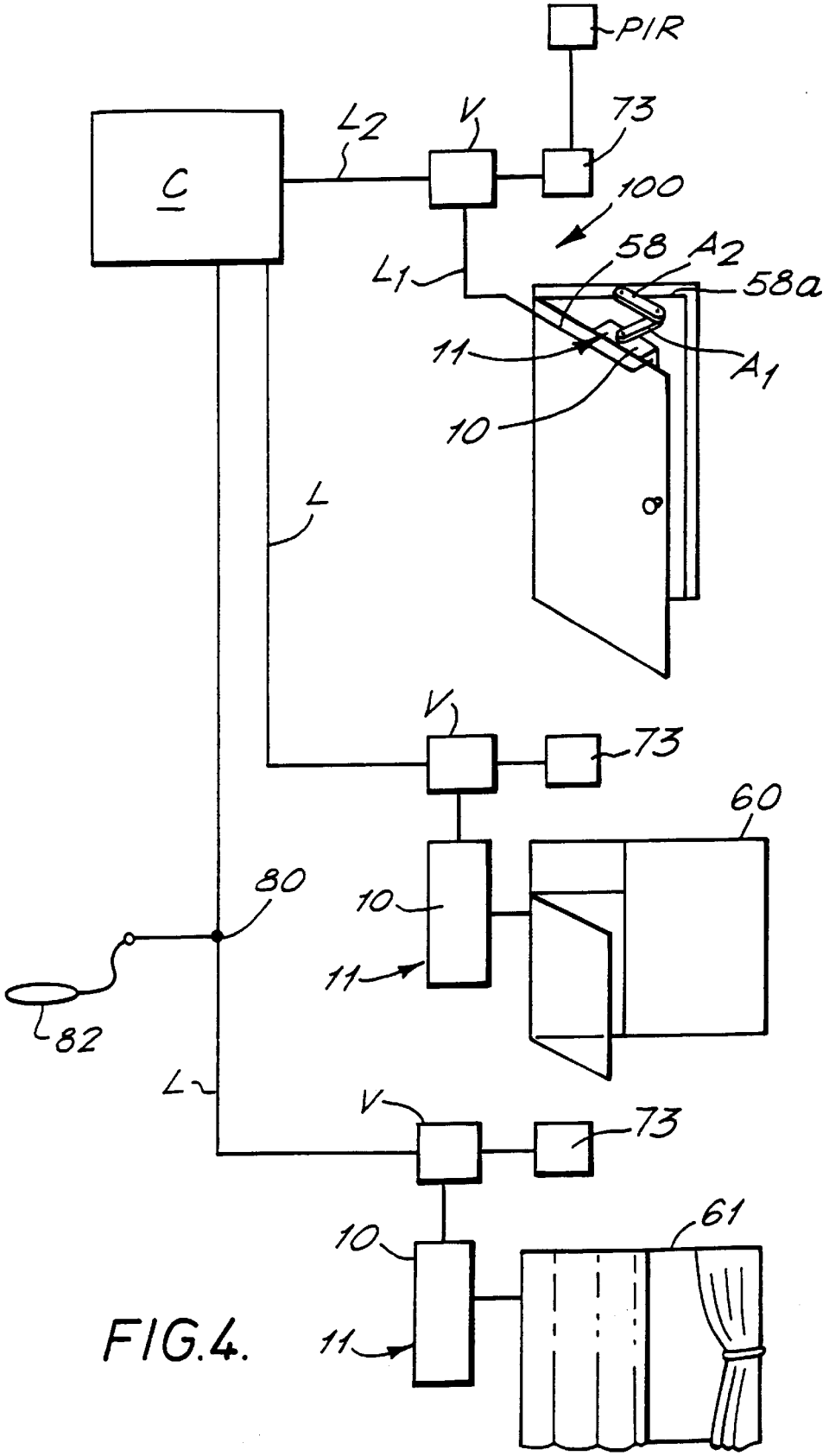
Fig. 4 is a schematic illustration of a system in accordance with the invention applied to the opening and closing of doors, windows and curtains.

If the door is opened manually, the drive shaft 34 turns the gear 32 which moves the rack 24, causing the piston 12 to move to the right. Air is drawn from atmosphere via valve V to the left side of the piston and the oil circulates as described above. When the door is released, the door closes as described previously under the action of spring 16. In FIG. 4, the system comprises a single compressor C which drives devices 11 for a door 58, a window 60 and a pair of curtains 61. The devices 11 for the window 60 and curtains 61 are illustrated diagrammatically.

Figure 3:
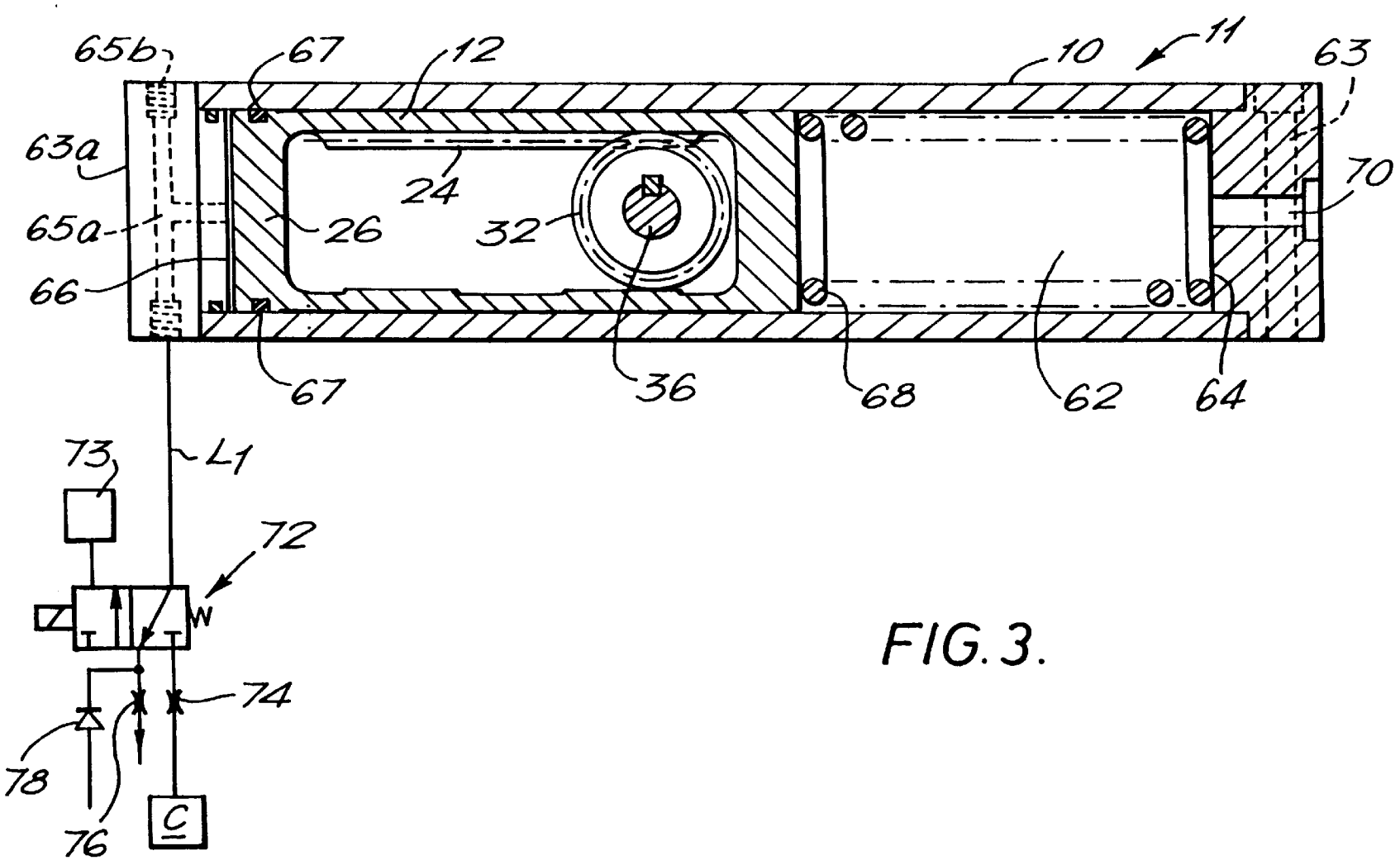
Fig. 3 is a longitudinal cross-section through another pneumatic device in accordance with the invention.

FIG. 3 shows another pneumatic device in accordance with the invention. Parts corresponding to parts in FIGS. 1 and 2 carry the same reference numerals.

A cylinder 10 of a pneumatic device 11 comprises a piston 12 slidably mounted in a bore 62. One end of the bore 62 is sealed by an end stop 63 and the other end of the bore is sealed by a stop 63*a* with air passageways 65*a*, 65*b* formed therein as illustrated.

The piston 12 is biased away from the end stop 63 by means of a compression spring 68. The length of the cylinder 10 is selected to accommodate the desired length of spring 68. The piston 12 has a similar toothed rack/gear wheel arrangement to that of the device of FIGS. 1 and 2 and thus will not be described further here. A gas-tight annular seal 67 is carried by the piston 12 adjacent the left hand end thereof as viewed in FIG. 3.

The end stop 63 has a breather passageway 70 leading from the bore 62 to atmosphere to allow air to flow in and out of the bore 62 on the spring side of the piston 12.

The air passageway 65*a* communicates with the bore 62 and is connected, via an air line L1, to a solenoid operated valve 72.

The solenoid of valve 72 can be switched on and off by means of an operating button 73. The valve 72 switches between an input flow path, which allows air to flow from compressor C via an opening speed control orifice 74 to the bore 62, and an output flow path, which allows air to flow from the bore 62 via a closing speed control orifice 76 to atmosphere.

In use, the cylinder 10 is arranged as described in relation to the cylinder of FIGS. 1 and 2 above. The solenoid of valve 72 is normally switched off so that the output flow path is normally selected. To open the door 52, the user presses the button 73 which switches on the solenoid of valve 72 causing the valve to select the input flow path. Air from the compressor C travels to the bore 62 via the opening speed control orifice 74 which restricts the rate of air flow into the bore 62. The air flowing into the bore 62 forces the piston 12 towards the end stop 63 against the bias of the spring 68. As in the pneumatic device of FIGS. 1 and 2, the rack 24 on the inside of the piston 12 causes the gear wheel 32 and hence the drive shaft 34 to turn, thereby opening the door 58.

When the door 58 is to be closed, the button 73 is operated to switch off the solenoid of valve 72 causing the valve 72 to select the output flow path position. The spring 68 then forces the piston 12 back towards the stop 63*a*, forcing the air out of the bore via air passageway 65*a* and through the closing speed control orifice 76 to atmosphere. The orifice 76 restricts the rate of air flow to atmosphere, thus limiting the closing speed of the door 52. As the piston moves back towards end stop 63*a*, the rack 24 turns the gear wheel 32 and drive shaft 34 in the opposite sense, closing the door 58.

If the door 58 is opened manually when the solenoid of valve 72 is switched off the arms A1, A2 cause the drive shaft 34 to turn the gear wheel 32 and drive the piston 12 against the bias of the spring 68 toward the end stop 63. The piston 12 draws air from atmosphere into the bore 62 via the valve 72 and a non-return valve 78. The door 52 subsequently closes as described above.

Instead of the valve 72 being solenoid-operated, it could be manually operated. Whilst specific reference has been made to the use of compressed air, it is envisaged that any other suitable gas could be used to provide door opening, such as compressed carbon dioxide.

Furthermore, it is envisaged that either device described could be used to provide a door closer in place of conventional hydraulic door closers. In such a case, the compressor C would not be required, as air would be drawn into the cylinder 10 by the action of opening the door 58.

It is envisaged that a pneumatic system in accordance with the invention could also be used for driving a device for lifting elderly or infirm people into and out of bed or the bath. Furthermore, the presence of a convenient pneumatic system in a building where bed-ridden people are present, allows the location of convenient air points 80 (see FIG. 4) for inflation/deflation of beds and air cushions 82 to alleviate and help prevent bed-sores.

Figure 5:
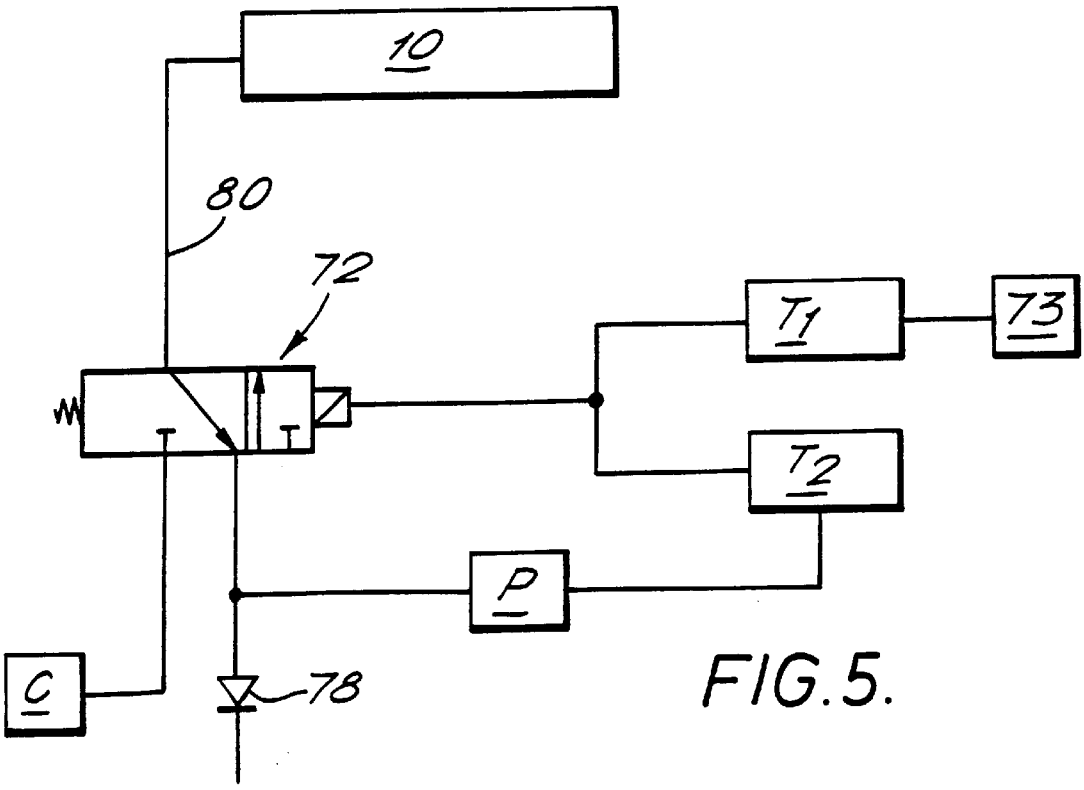
Fig. 5 is a schematic illustration of a valve arrangement for use with the devices of FIGS. 1 to 3.

FIG. 5 shows an alternative valve arrangement for use with the devices of FIGS. 1 to 3. In FIG. 5 the cylinder 10 is connected to a solenoid valve 72 similar to that described in relation to FIG. 3 via a common path 80.

The valve 72 is switchable between two paths. The first path connects the compressor C to the common path 80 while the second path connects the common path 80 to atmosphere via a non-return valve 78 which allows passage of gas to atmosphere. The valve 72 is normally set to select the second path.

The second path has a branch upstream of the non-return valve 78. A pressure switch P is arranged in the branch. The door button 73 is connected to a timer $T_1$ which in turn is connected to the valve 72 and which can operate the valve 72 to switch it to the compressor path for a predetermined period $t_1$. The pressure switch P is arranged to switch on timer $T_2$ when the pressure in the path to atmosphere drops. The timer $T_2$ is connected to the valve 72 and can operate the valve 72 to switch it to the compressor path for a predetermined period $t_2$ where $t_1>t_2$.

Thus when a user presses the button 73, the timer $T_1$ operates the valve 72 to switch it to the compressor path. The compressor C supplies compressed air to the cylinder 10 to open the door. After the period $t_1$ has expired the valve 72 is switched back to the path to atmosphere and the cylinder is vented to atmoshphere allowing the door to close in the manner descibed above.

If a user attempts to open the door manually, the initial movement of the door causes a drop in pressure in the path to atmosphere which, in turn, activates the pressure switch P. The switch P initiates the timer $T_2$ which switches the valve 72 to the compressor path to open the door. After the shorter period $t_2$ has expired, the valve 72 is switched back to the path to atmosphere to allow the door to close as described previously.

In that system the door opens automatically whether activated by the button 73 or by manual pressure.

I claim:

1. A pneumatic device comprising a body, the body defining a bore, a piston movable in the bore against a resilient bias, the piston having opposite ends defining a chamber therebetween, a wall provided in the chamber fixed relative to the body and having opposite sides and a fluid flow control aperture therethrough, the chamber being divided by the wall and being filled with fluid, movement of the piston against the resilient bias causing the fluid to be displaced from one side of the wall to the opposte side through the aperture, the resilient bias being arranged to apply a return force to the piston, whereby the rate of return of the piston is controlled by a return flow of fluid through the aperture.

2. A pneumatic device according to claim 1 in which the piston is formed with a drive surface for operating a drive member.

3. A pneumatic device according to claim 2 in which the drive member is rotatable.

4. A pneumatic device according to claim 3 in which the drive surface is a toothed rack and the drive member is a pinion.

5. A pneumatic device according to claim 4 in which the ends of the piston are connected by the rack.

6. A pneumatic device according to claim 5 in which the rack extends through an opening in the wall and the aperture is defined by a clearance between the rack and the opening.

7. A pneumatic device according to claim 2 in which the wall supports the drive member.

8. A pneumatic device according to claim 1 in which the wall defines a through bore having a non-return valve disposed therein, the valve being arranged so that only fluid displaced from said one side into said opposite side is allowed to pass through the bore.

9. A pneumatic device according to claim 1 in which the wall defines a regulator through-bore said bore having a flow control valve therein, the valve having a member movable to alter a cross sectional area of the regulator through bore so that a flow rate of fluid from said opposite side to said one side can be regulated.

10. A pneumatic device for connecting between two members, one of which is movable relative to the other at a pre-determined rate, the device comprising a body having a bore, a piston reciprocal in the bore against a resilient bias, rate of movement of the piston being controlled by gas flow control means.

11. A pneumatic device according to claim 10 in which the resilient bias is arranged so that gas is drawn into the bore when the piston moves against the resilient bias and the gas flow control means controls the rate at which the drawn-in gas is expelled from the bore.

12. A pneumatic device according to claim 10 in which the rate at which the piston travels against the resilient bias is undamped by the gas flow control means.

13. A pneumatic device for connecting between two members, one of which is movable relative to the other at a pre-determined rate, the device comprising a body having a bore, a piston reciprocal in the bore against a resilient bias, the rate of movement of the piston being controlled by gas control means and, the gas flow control means comprising a suitable valve adapted to select an inlet path for movement of the piston against the resilient bias or an outlet path for movement of the piston in the opposite direction.

14. A pneumatic device according to claim 13 in which the outlet path includes a restrictor.

15. A pneumatic device according to claim 13 in which the inlet path leads from a source of compressed gas.

16. A pneumatic device according to claim 15 in which a further path is provided in parallel with the outlet path leading from atmosphere via a non-return return vale to the bore.

17. A pneumatic system including a device comprising a body, the body defining a bore, a piston movable in the bore against a resilient bias, the piston having opposite ends defining a chamber therebetween, a wall being provided in the chamber fixed relative to the body and having opposite sides and a fluid flow control aperture therethrough, the chamber being divided by the wall and being filled with fluid, movement of the piston against the resilient bias causing the fluid to be displaced from one side of the wall to the opposite side through the aperture, the resilient bias being arranged to apply a return force to the piston, whereby the rate of return of the piston is controlled by the return flow of fluid through the aperture, and a source of compressed gas for operating the device to move a first member relative to a second member and a switching device which causes the compressed gas to be suppled to the device.

18. A pneumatic system according to claim 17 in which the device is arranged to open a door when compressed gas is supplied thereto and subsequently to provide a closing movement for the door which is damped for at least part of its return movement.

19. A pneumatic system according to claim 18 in which a sensor is arranged near the door to sense the proximity of a person approaching the door and to operate the switching device to open the door.

20. A pneumatic system according to claim 18 in which the device includes a door movement sensor which activates the device to open the door when manual force is applied to the door.

21. A pneumatic system according to claim 20 in which the movement sensor senses a change in pneumatic pressure in the device.

22. A pneumatic system including a device comprising a body having a bore, a piston reciprocal in the bore against a resilient bias, a rate of movement of the piston being controlled by gas flow control means, and a source of compressed gas for operating the device to move a first member relative to a second member and a switching device which causes the compressed gas to be supplied to the device.

23. A pneumatic system including a device comprising a body having a bore, a piston reciprocal in the bore against a resilient bias, a rate of movement of the piston being controlled by gas flow control means, and a source of compressed gas for operating the device to move a first member relative to a second member and a switching device which causes the compressed gas to be supplied to the device, and the device being arranged to open a door when compressed gas is supplied thereto and subsequently to provide a closing movement for the door which is damped for at least part of its return movement.

24. A pneumatic system according to claim 23 in which a sensor is arranged near the door to sense the proximity of a person approaching the door and to operate the switching device to open the door.

25. A pneumatic system according to claim 23 in which the device includes a door movement sensor which activates the device to open the door when manual force is applied to the door.

26. A pneumatic system according to claim 25 in which the movement sensor senses a change in pneumatic pressure in the device.

* * * * *